US011835912B2

(12) United States Patent
Torimaru

(10) Patent No.: US 11,835,912 B2
(45) Date of Patent: Dec. 5, 2023

(54) IMAGE FORMING APPARATUS

(71) Applicant: CANON KABUSHIKI KAISHA, Tokyo (JP)

(72) Inventor: Yuusuke Torimaru, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/988,045

(22) Filed: Nov. 16, 2022

(65) Prior Publication Data

US 2023/0168621 A1 Jun. 1, 2023

(30) Foreign Application Priority Data

Nov. 26, 2021 (JP) ..... 2021-192320
Jul. 19, 2022 (JP) ..... 2022-114743

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/88
See application file for complete search history.

(56) References Cited

U.S. PATENT DOCUMENTS 7,848,669 B2 12/2010 Torimaru
9,639,021 B2 5/2017 Matsudaira et al.
2016/0187803 A1 6/2016 Matsudaira et al.

FOREIGN PATENT DOCUMENTS

CN 113110000 A * 7/2021 ..... G03G 15/1695
JP 2016-122156 A 7/2016

OTHER PUBLICATIONS

Computer translation of CN 113110000A to Tanaka (Year: 2021).*

* cited by examiner

*Primary Examiner* — Quana Grainger
(74) *Attorney, Agent, or Firm* — Venable LLP

(57) ABSTRACT

An image forming apparatus includes a transfer portion, a fixing portion to fix the toner image onto the sheet, and a charge adjusting portion. The charge adjusting portion adjusts charge to the sheet on which the toner image is fixed. The charge adjusting portion is provided with first and second rollers, a supplying rotatable member and a power source. The first roller includes a shaft having conductivity and an outer circumferential portion including an ion conductive material formed on an outer periphery of the shaft, and is electrically floating. The second roller is disposed so as to nip the sheet between itself and the first roller. The supplying rotatable member is in contact with the first roller and supplies a current to the first roller. The power source applies a voltage of one polarity of a positive polarity and a negative polarity to the supplying rotatable member.

20 Claims, 13 Drawing Sheets

(a)

(b)

(a)

(b)

IMAGE FORMING APPARATUS

FIELD OF THE INVENTION AND RELATED ART

The present invention relates to an image forming apparatus such as a copier, printer, FAX, or a multifunctional machine that has two or more of these functions.

In an image forming apparatus, a toner image formed in an image forming portion is transferred to a sheet in a transfer portion, and after fixing the toner image on the sheet in a fixing portion, the sheet is stacked in a discharge tray or the like. In this process, sheets may stick to each other due to electrostatic force between sheets. For this reason, a configuration with a charge adjusting portion that applies a voltage to the sheet on which the toner image has been fixed by the fixing portion to adjust the electric charge of the sheet has been proposed (Japanese Laid-Open Patent Application No. 2016-122156).

In the Patent Application, the charge adjusting portion is composed of a pair of conductive rubber rollers positioned opposite each other and a power supply source that applies voltage to the conductive rubber rollers and to the sheet that passes through the nip portion of the pair of conductive rubber rollers.

However, when rollers containing ion-conductive materials are used as conductive rubber rollers, the resistance of the rollers increases due to current flow, which may prevent stable charge adjustment of the sheet over a long period of time.

SUMMARY OF THE INVENTION

The present invention aims to provide an apparatus that can stably adjust the charge of sheets over a long period of time.

The present invention is equipped with an image forming apparatus comprising: a transfer portion configured to transfer a toner image on a sheet; a fixing portion configured to heat and press the sheet on which the toner image is transferred by the transfer portion, and to fix the toner image onto the sheet; and a charge adjusting portion configured to adjust charge to the sheet on which the toner image is fixed by the fixing portion, wherein the charge adjusting portion is provided with a first roller including a shaft portion having conductivity and an outer circumferential portion including an ion conductive material formed on an outer periphery of the shaft portion, and being electrically floating, a second roller disposed so as to nip the sheet between itself and the first roller; a supplying rotatable member in contact with the first roller and configured to supply a current to the first roller; and a power source configured to apply a voltage of one polarity of a positive polarity and a negative polarity to the supplying rotatable member.

The present invention is equipped with an image forming apparatus comprising: a transfer portion configured to transfer a toner image on a sheet; a fixing portion configured to heat and press the sheet on which the toner image is transferred by the transfer portion, and to fix the toner image onto the sheet; and a charge adjusting portion configured to adjust charge to the sheet on which the toner image is fixed by the fixing portion, wherein the charge adjusting portion is provided with a first roller including a shaft portion having conductivity and an outer circumferential portion including an ion conductive material formed on an outer periphery of the shaft portion, and grounded, a metallic second roller disposed so as to nip the sheet between itself and the first roller; a supplying rotatable member in contact with the first roller and configured to supply a current to the first roller; a first power source configured to apply a voltage of one polarity of a positive polarity and a negative polarity to the supplying rotatable member, and a second power source configured to apply a voltage of the other polarity of the positive polarity and the negative polarity to the second roller.

Further features of the present invention will become apparent from the following description of exemplary embodiments with reference to the attached drawings.

Figure 5:
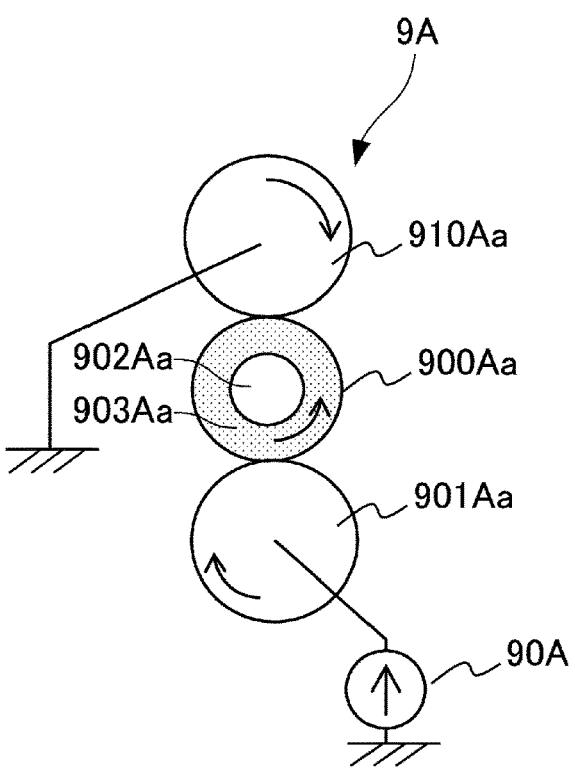
Figure 5:
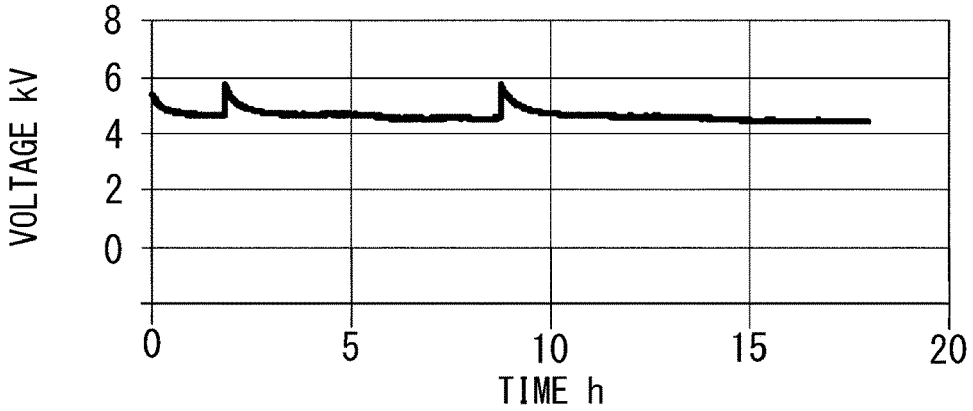

Part (a) of FIG. 5 is a schematic cross-sectional view of a charge adjusting unit according to Example 1, and part (b) of FIG. 5 is a graph showing the measurement results of voltage fluctuations of the charge adjusting unit according to Example 1.

Figure 6:
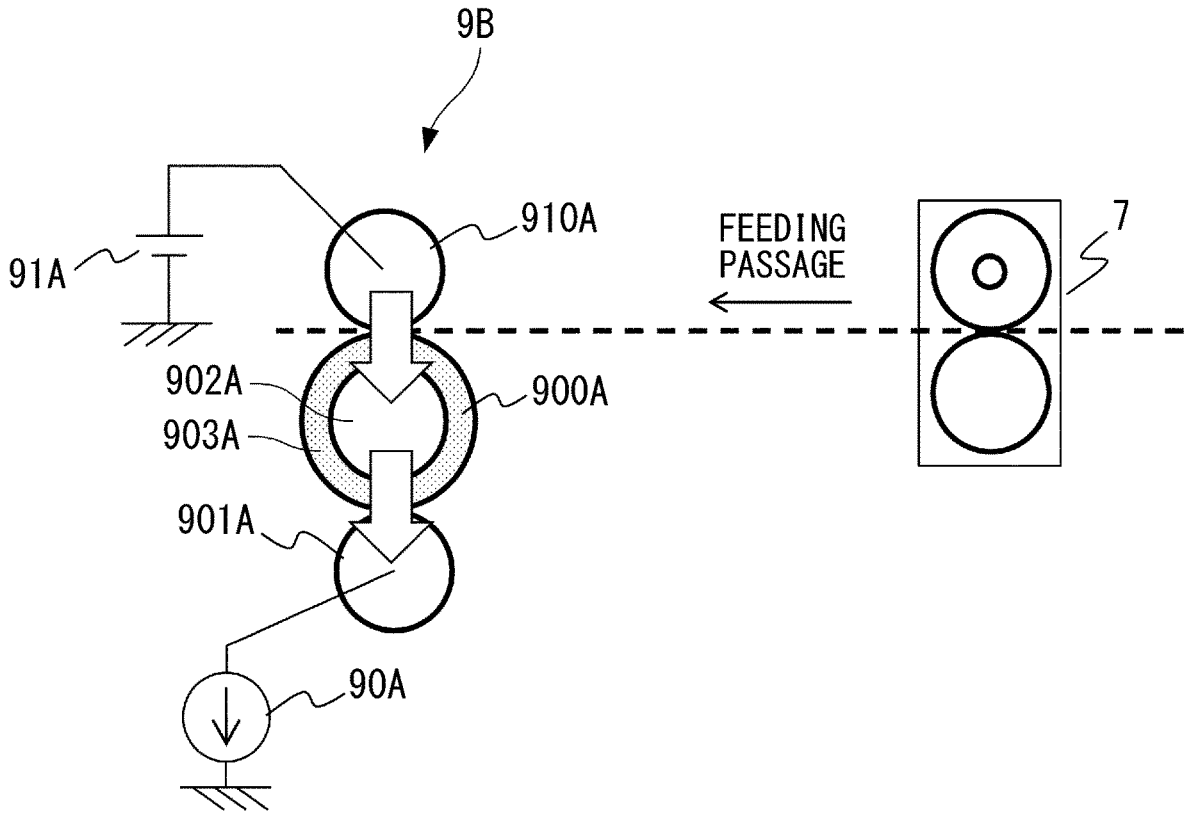

FIG. 6 is a schematic cross-sectional view of a charge adjusting unit according to a modified example of the first embodiment.

Figure 7:
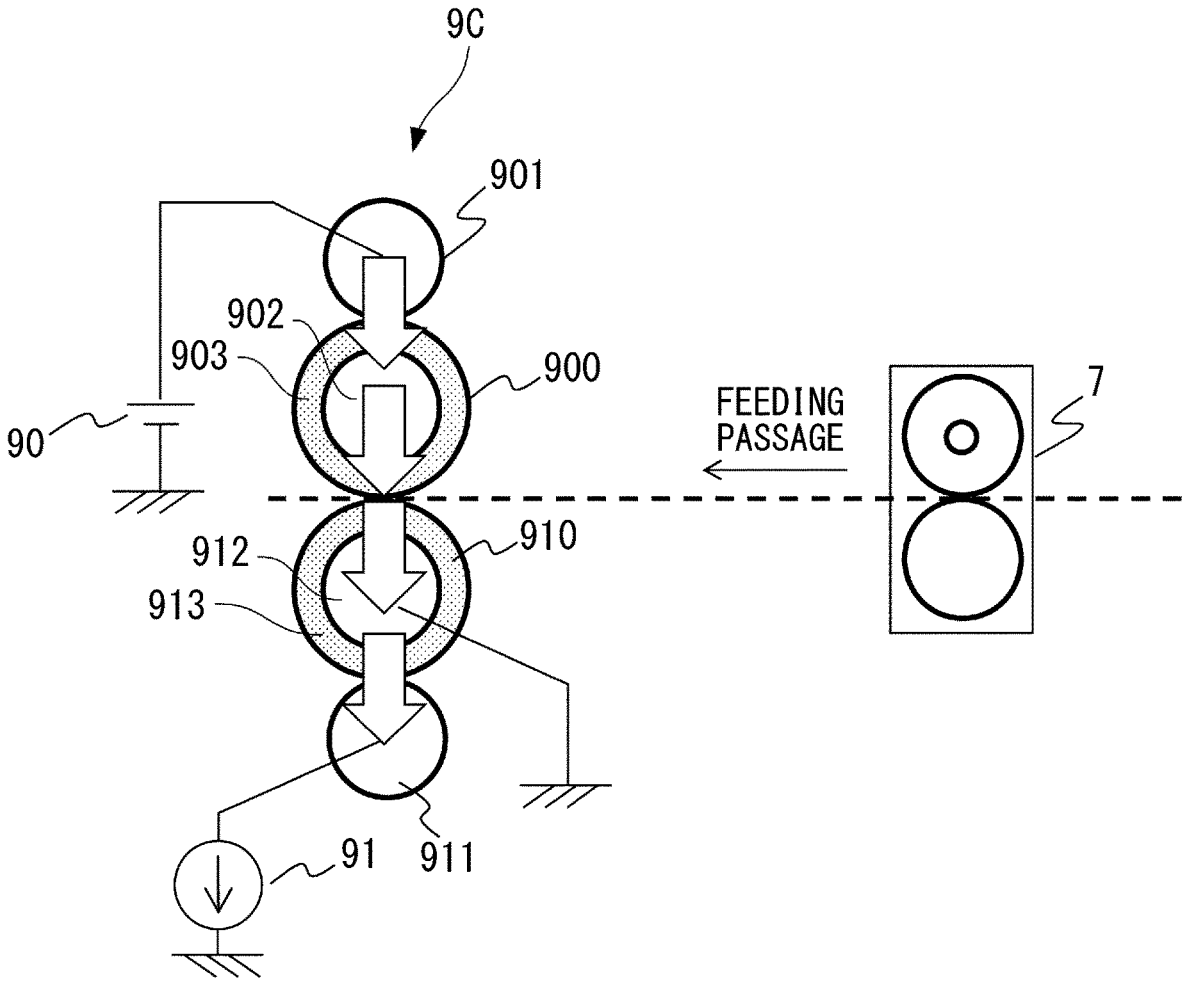

FIG. 7 is a schematic cross-sectional view of a charge adjusting unit according to a modified example 2 of the first embodiment.

Figure 8:
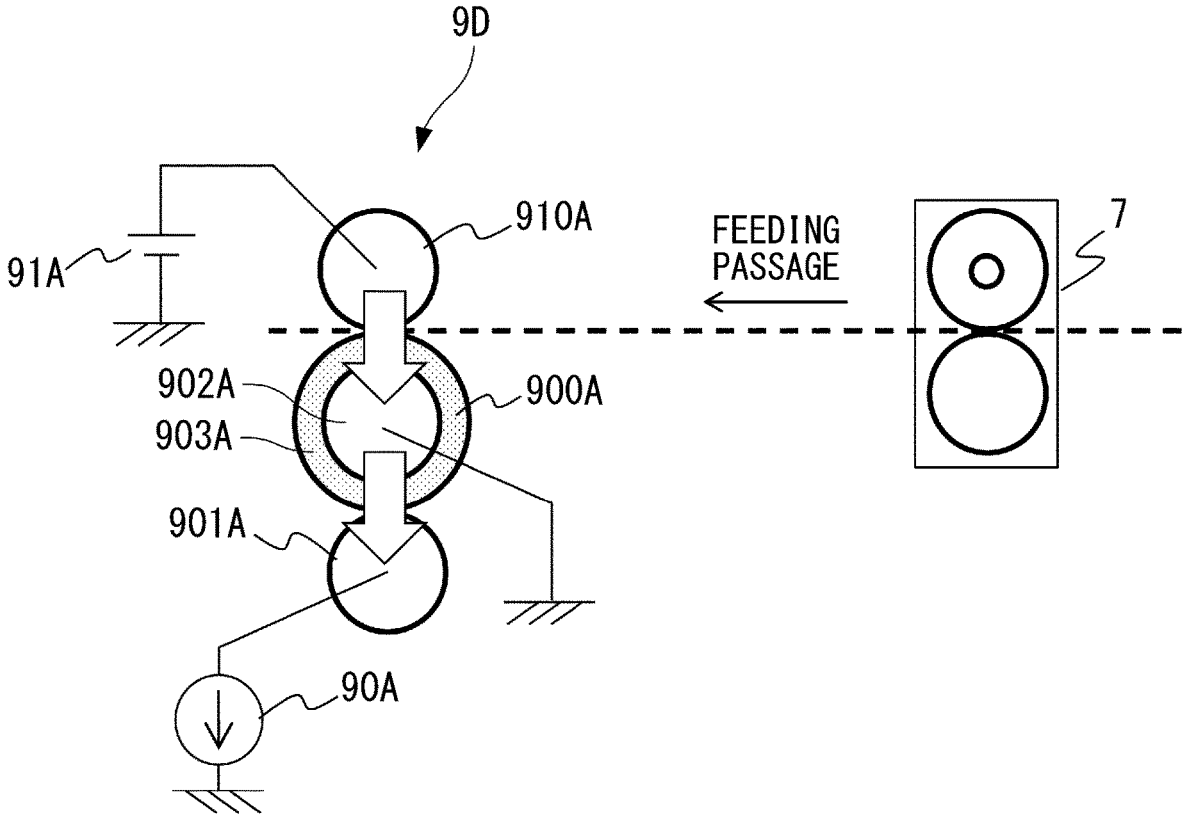

FIG. 8 is a schematic cross-sectional view of a charge adjusting unit according to the second embodiment.

Figure 9:
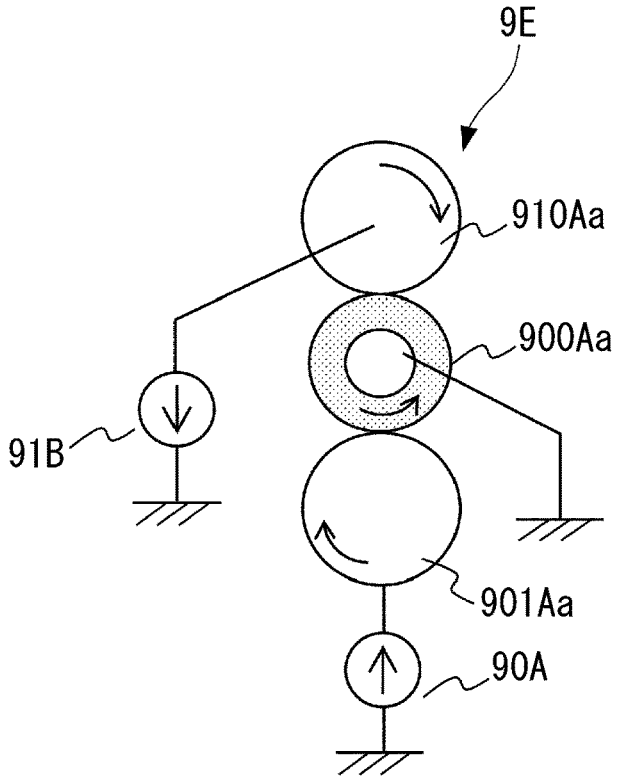
Figure 9:
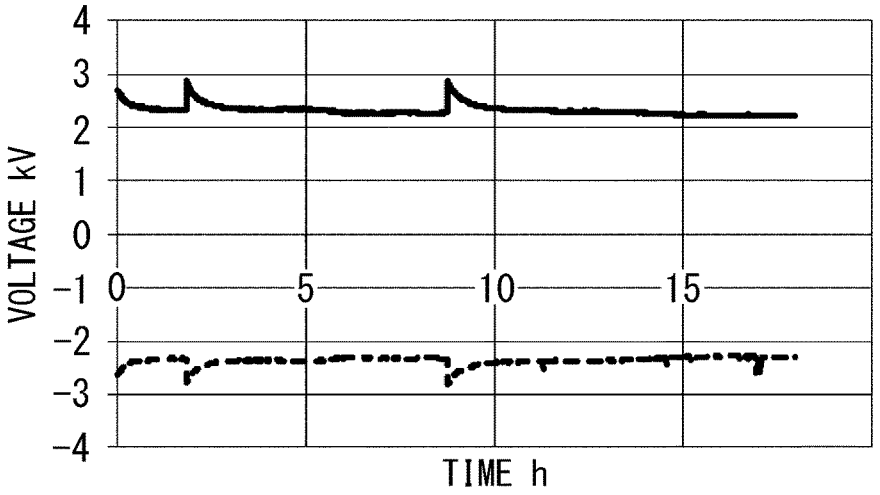

Part (a) of FIG. 9 is a schematic cross-sectional view of a charge adjusting unit according to Example 2, and part (b) of FIG. 9 is a graph showing the measurement results of voltage fluctuations of the charge adjusting unit according to Example 2.

Figure 10:
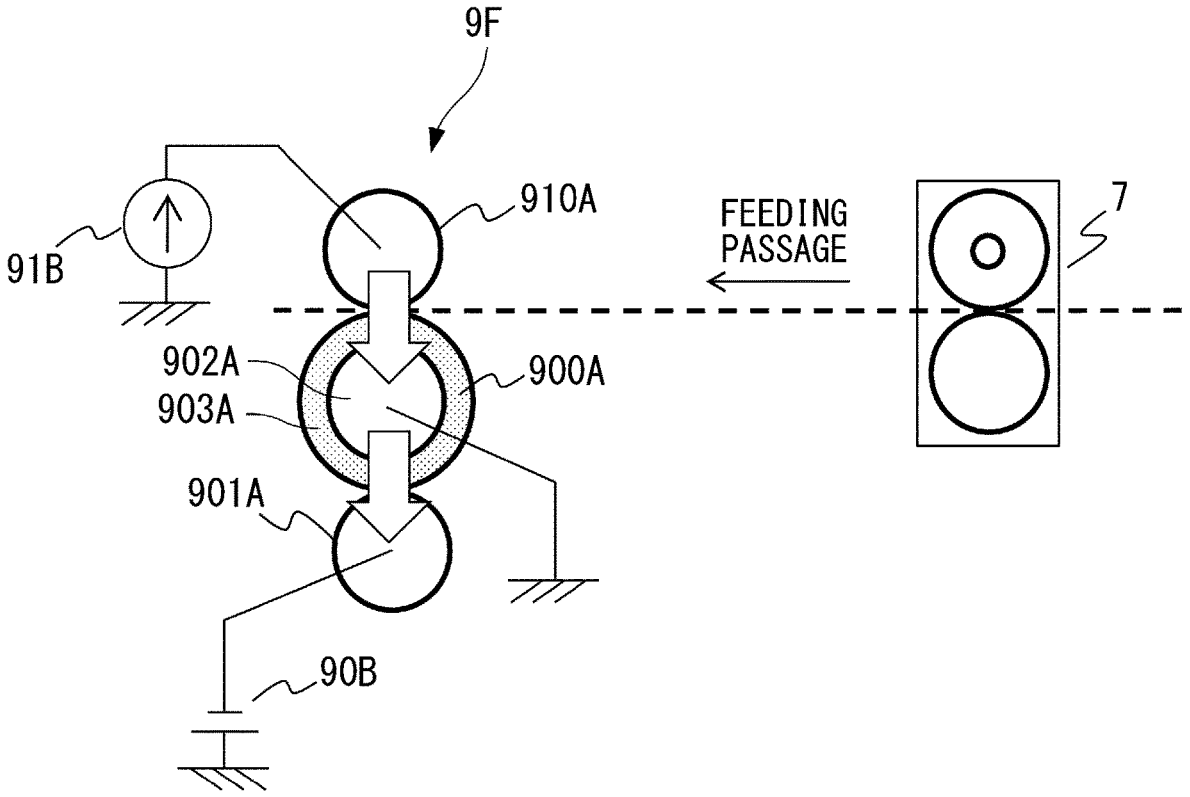

FIG. 10 is a schematic cross-sectional view of a charge adjusting unit according to a modified example 3 of Embodiment 2.

Figure 11:
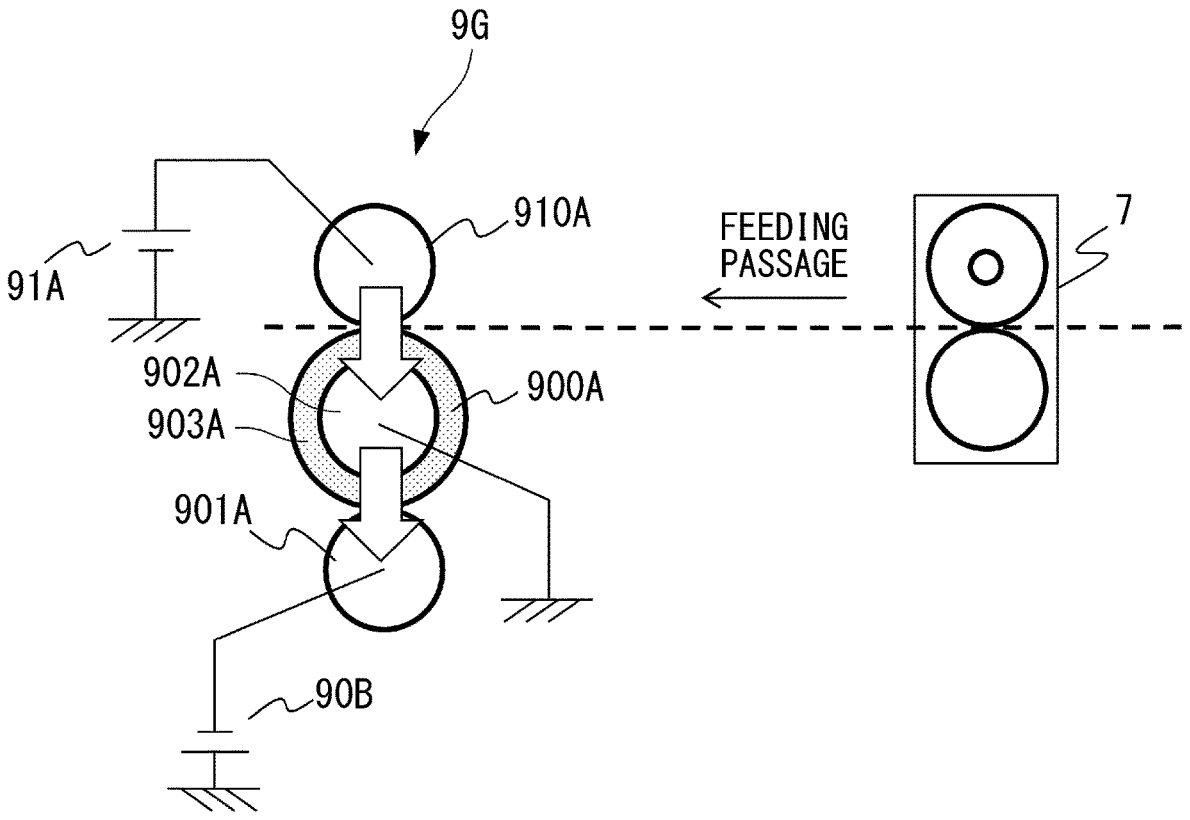

FIG. 11 is a schematic cross-sectional view of a charge adjusting unit according to a modified example 4 of Embodiment 2.

Figure 12:
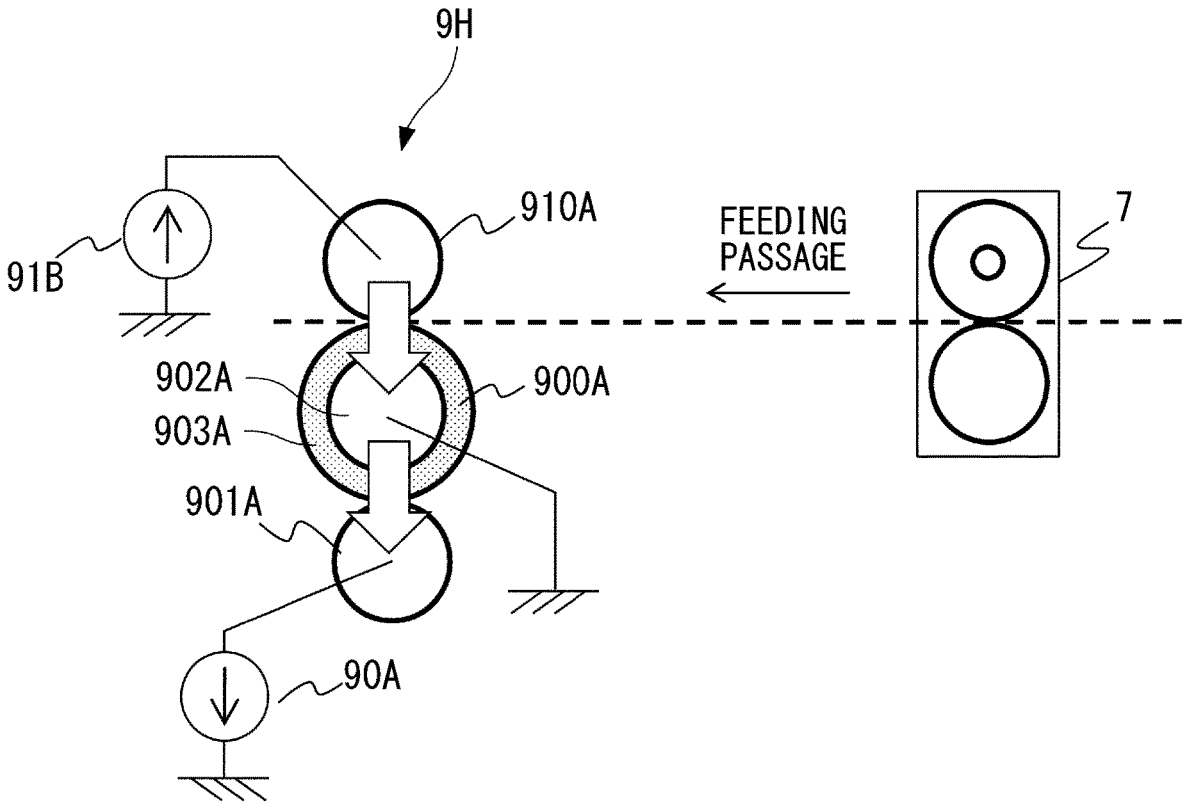

FIG. 12 is a schematic cross-sectional view of a charge adjusting unit according to a modified example 5 of Embodiment 2.

Figure 13:
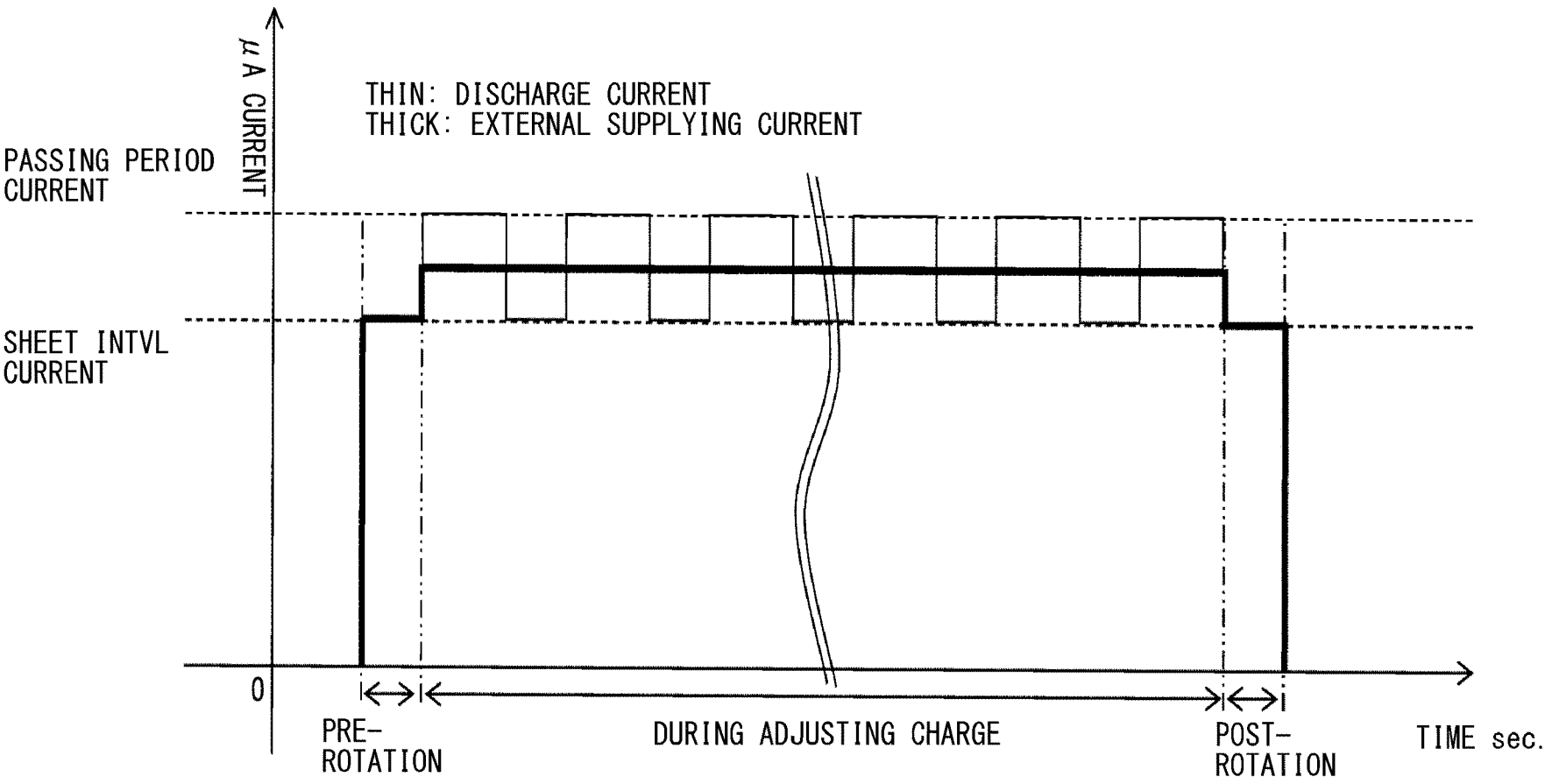

FIG. 13 is a graph showing the relationship between static elimination current and external feed current in Example 3.

DESCRIPTION OF THE EMBODIMENTS

First Embodiment

The first embodiment is explained using FIGS. 1 through 7. First, the schematic configuration of the image forming apparatus of the present embodiment is explained using FIGS. 1 and 2.

[Image Forming Apparatus]

Figure 1:
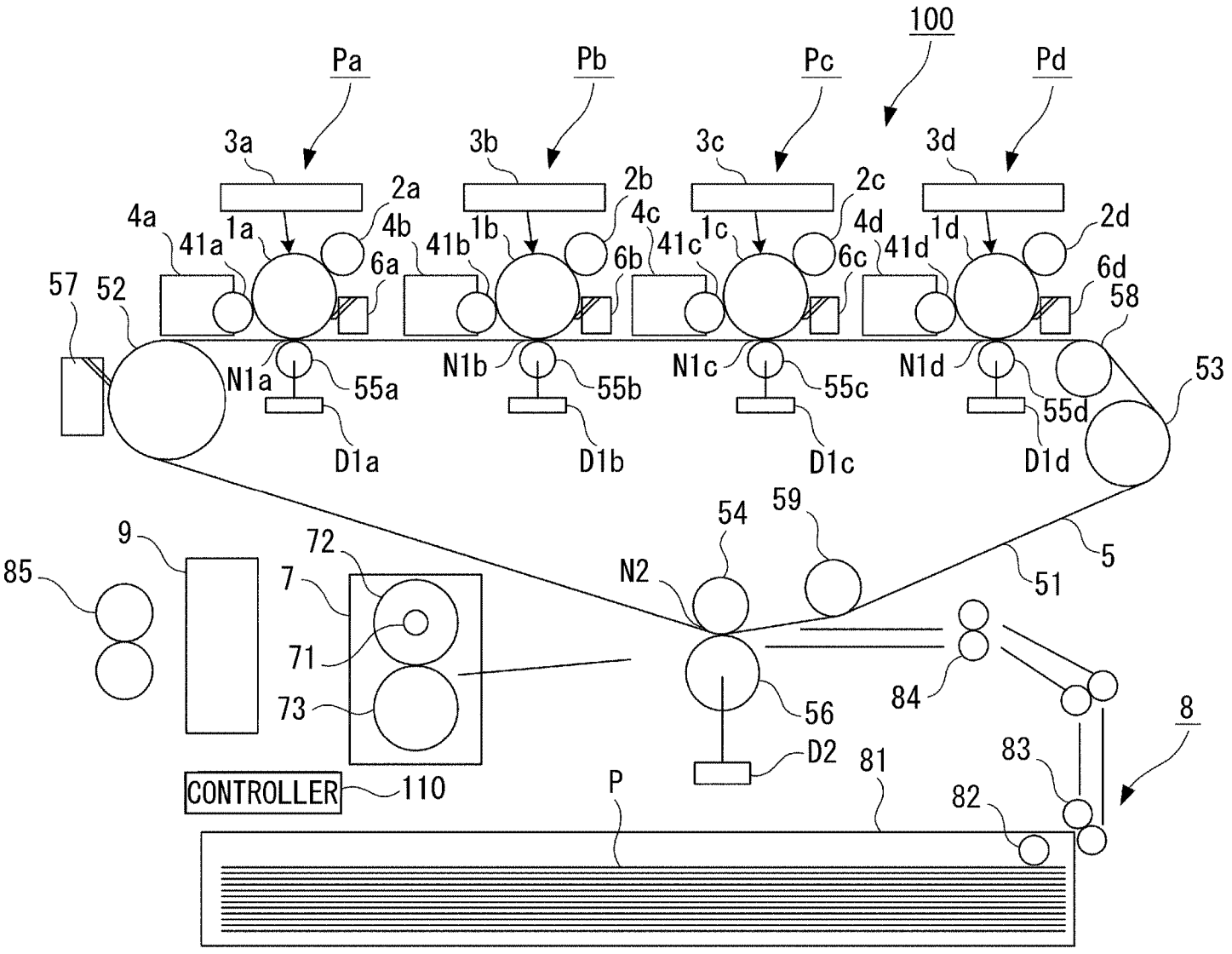
FIG. 1 is a schematic cross-sectional view of an image forming apparatus according to the first embodiment.

As shown in FIG. 1, an image forming apparatus 100 in the present embodiment is a laser beam printer that forms a full-color image on a sheet P (paper, OHP sheet, cloth, etc.) as a recording material using an electrophotographic method. The image forming apparatus 100 is an intermediate transfer tandem apparatus, in which image forming portions Pa, Pb, Pc, and Pd, which are yellow, magenta, cyan, and black toner image forming means, are arranged along an intermediate transfer belt 51.

Image forming portions Pa, Pb, Pc, and Pd are equipped with photosensitive drums 1*a*, 1*b*, 1*c*, and 1*d*, respectively, as image bearers and photosensitive members bearing an electrostatic latent image. In the image forming portion Pa, a yellow toner image is formed on the photosensitive drum 1*a* and is primarily transferred to the intermediate transfer belt 51 as the intermediate transfer body. In the image forming portion Pb, a magenta toner image is formed on the photosensitive drum 1*b* and is primarily transferred over the yellow toner image on the intermediate transfer belt 51. In the image forming portions Pc and Pd, cyan toner and black toner images are formed on the photosensitive drums 1*c* and 1*d*, respectively, and are similarly superimposed in position on the toner image on the intermediate transfer belt 51 for sequential primary transfer. In the present embodiment, the photosensitive drums and the intermediate transfer belt serve as image bearers that carry the toner images.

The four-color toner image that has been primarily transferred to the intermediate transfer belt 51 is secondarily transferred to a sheet P fed to a secondary transfer portion N2 formed by the intermediate transfer belt 51 and a secondary transfer roller 56. The sheet P to which the toner image is secondarily transferred in the secondary transfer portion N2 is heated and pressurized in a fixing unit 7 as the fixing portion, and after the toner image is fixed on the surface, the sheet P is ejected to the outside and stacked on an unshown discharge tray.

A feeding unit 8 feeds sheets P drawn from a cassette 81 by a pickup roller 82, separated into individual sheets by a separator 83, and then fed to a registration roller 84. The registration roller 84 accepts and waits for the sheet P in a stopped state, and then feeds the sheet P to a secondary transfer portion N2, timed to the toner image on the intermediate transfer belt 51.

An intermediate transfer unit 5 rotates the intermediate transfer belt 51, which is an example of an image bearer, in the direction of arrow R2 by suspending it over a driving roller 52, support rollers 58 and 59, tension roller 53, and opposing roller 54. The opposing roller 54 is positioned opposite a secondary transfer opposing roller 56 via the intermediate transfer belt 51. The outer circumference of the intermediate transfer belt 51, which is crossed over the opposing roller 54, and the secondary transfer opposing roller 56 form the secondary transfer portion N2 that nips the sheet.

A power source D2 is connected to the secondary transfer roller 56, and a secondary transfer bias is applied to the secondary transfer roller 56. When a secondary transfer is performed, a high-voltage positive (positive polarity) transfer voltage (secondary transfer bias) is applied to the secondary transfer roller 56 to electrostatically attract the toner image, which is negatively charged (negative polarity), to the sheet. As a result, the toner image carried on the intermediate transfer belt 51 is secondarily transferred to the sheet P passing through the secondary transfer portion N2.

The fixing unit 7 forms a fixing nip portion by pressing a pressure roller 73 against a fixing roller 72 with a lamp heater 71 arranged in the center. In a heating nip portion, the sheet P onto which the toner image has been transferred in the secondary transfer portion N2 is heated and pressurized to fix the toner image on a sheet P. The sheet P that has undergone the fixing portion is then ejected from the apparatus by an discharge roller 85 as the discharge portion, and is stacked in an ejection tray or the like.

The belt cleaning unit 57 slides a cleaning blade across the intermediate transfer belt 51 to remove transfer residual toner, paper dust, and other residuals on the surface of the intermediate transfer belt 51 after the sheet P has passed through the secondary transfer portion N2 and been separated.

The image forming portions Pa, Pb, Pc, and Pd are configured almost identically, except that the colors of toner used in developing units 4*a*, 4*b*, 4*c*, and 4*d* attached to photosensitive drums 1*a*, 1*b*, 1*c*, and 1*d*, respectively, are different: yellow, magenta, cyan, and black. In the following, the image forming portion Pa will be described with reference to FIG. 2, and the other image forming portions Pb, Pc, and Pd will be described by replacing a at the end of the symbol with b, c, and d in the description.

Figure 2:
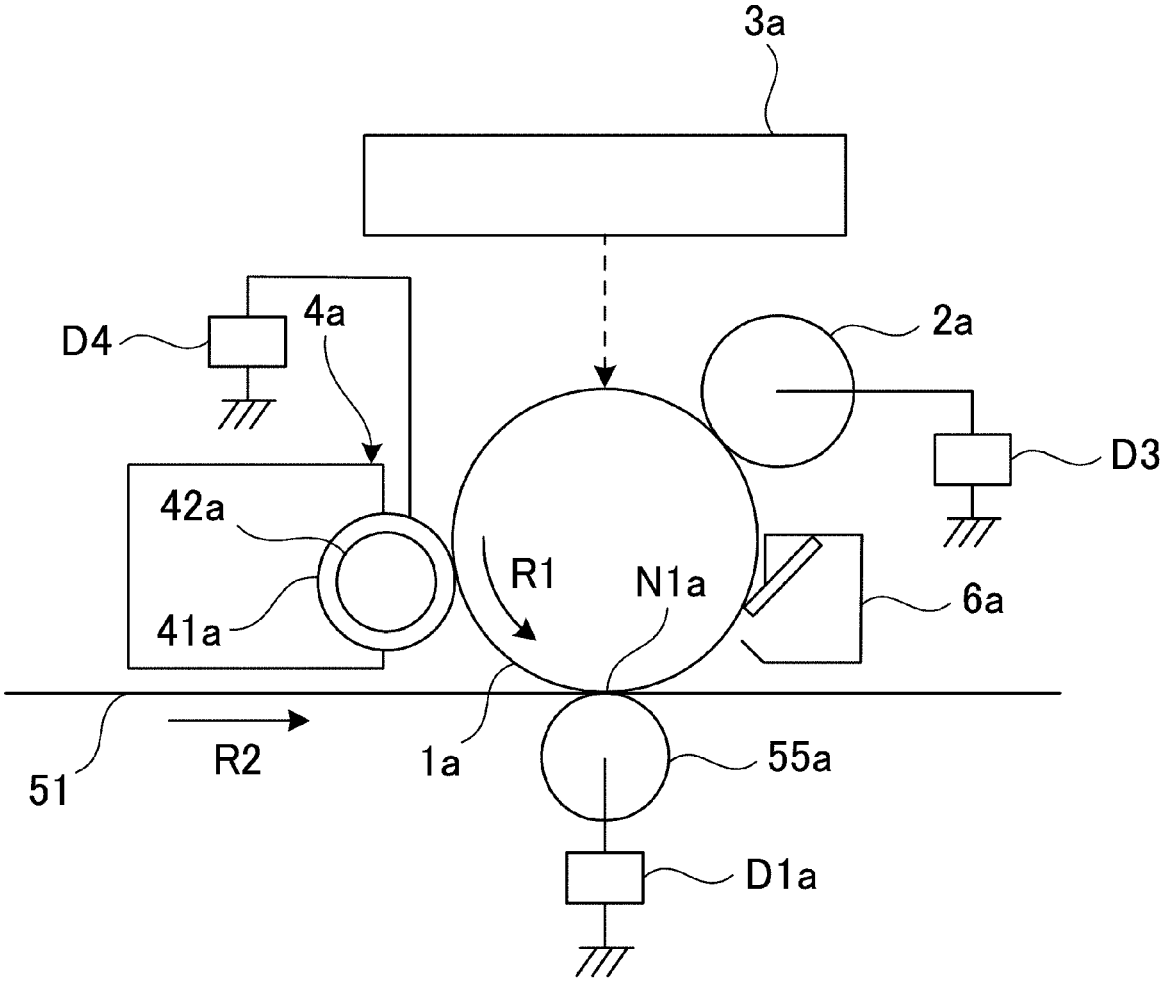
FIG. 2 is a schematic cross-sectional view of an image forming portion according to the first embodiment.

As shown in FIG. 2, the image forming portion Pa has a photosensitive drum 1*a* surrounded by a charging roller 2*a*, an exposure unit 3*a*, a developing unit 4*a*, a primary transfer roller 55*a*, and a cleaning unit 6*a*. The photosensitive drum 1*a* has an organic photoconductive layer (OPC) with negative charge polarity formed on the outer circumference of an aluminum cylinder, and rotates in the arrow R1 direction at a processing speed of 240 mm/sec.

The charging roller 2*a*, which is a charging member, is formed by covering the surface of the metallic central shaft with a resistive elastic layer and rotates driven by the photosensitive drum 1*a* under pressure. A power source D3 applies a DC voltage superimposed with an AC voltage to the charging roller 2*a* to charge the surface of the photosensitive drum 1*a* to a uniform negative polarity potential.

An exposure unit 3*a* writes an electrostatic image of the image on the surface of the photosensitive drum 1*a*, which is charged, by scanning a rotating mirror with a laser beam that is ON-OFF modulated with scanning line image data that develops a yellow resolved color image.

The developing unit 4*a* agitates the two-component developer, which is a mixture of nonmagnetic toner and magnetic carrier, to charge the nonmagnetic toner with negative polarity and the magnetic carrier with positive polarity, respectively. The charged two-component developer is carried in an chain electing state on a developing sleeve 41*a*, which rotates in a counter direction to the photosensitive drum 1*a* around a fixed magnetic pole 42*a*, and slides against the photosensitive drum 1*a*. The power source D4 applies a developing voltage, which is an AC voltage superimposed on a DC voltage of negative polarity, to the developing sleeve 41*a* to invert and develop the electrostatic image by moving the toner to the exposed portion of the photosensitive drum 1*a*, which is relatively more positive polarity than the developing sleeve 41*a*.

A primary transfer roller 55*a*, which is a primary transfer member, is pressed against the photosensitive drum 1*a* side to nip the intermediate transfer belt 51 to form a primary transfer portion N1*a* between the photosensitive drum 1*a* and the intermediate transfer belt 51. The power supply portion D1*a* is the transfer output portion that applies voltage to the primary transfer roller 55*a*, and applies a positive polarity DC voltage of +900 V as the primary transfer bias to the primary transfer roller 55*a*. As a result, the toner image charged with negative polarity and carried on the photosensitive drum 1*a* is primarily transferred to the intermediate transfer belt 51 that passes through the primary transfer portion N1*a*.

The primary transfer roller 55*a* is a semi-conductive one with a resistance of $1\times10^2$ to $10^8\Omega$ when 2000 V is applied. Specifically, an ion-conductive sponge roller with an outer diameter of φ16 mm and a metal core diameter of φ8 mm, formed from a blend of nitrile rubber and ethylene-epichlorohydrin copolymer, was used. The resistance of the primary transfer roller 55*a* is about $1\times10^{6}$-$10^{8}\Omega$ at an applied voltage of 2 kV under a temperature of 23° C. and a humidity of 50% RH.

The cleaning unit 6*a* slides the cleaning blade against the photosensitive drum 1*a* to remove the residual transfer toner adhering to the surface of the photosensitive drum 1*a* that has passed through the primary transfer portion N1*a*.

In recent years, the intermediate transfer method is used because of the wide variety of sheet types and the wide range of sheet thicknesses and electrical resistivities. In order to avoid changes in the amount of charge applied to the toner image due to differences in the image ratio in the main scanning direction, sheet width, etc., constant voltage control is adopted in the transfer portion (secondary transfer portion in the above example) that transfers the toner image onto the sheet. Furthermore, changes in the ambient environment, such as temperature and humidity, or the electrical resistance of the intermediate transfer belt and transfer roller, or the thickness of the surface layer of the photosensitive drum, accompany the accumulation of image formation. In order to optimize the voltage applied to the transfer roller during image forming according to these changes, ATVC control (Active Transfer Voltage Control) is performed to determine the control value of the constant voltage control prior to image forming.

The ATVC control is a control that applies several different test voltages to a secondary transfer roller 56 when there is no sheet in the secondary transfer portion N, detects the current with a current detection sensor at each transfer voltage to obtain the relationship between the transfer voltage and the current, and sets the transfer voltage (secondary transfer bias) to be applied to the secondary transfer portion N based on this relationship. The control of the entire image forming apparatus 100, including such ATVC control, is performed by a control portion 110 (FIG. 1).

The control portion 110 has a CPU (Central Processing Unit), ROM (Read Only Memory), and RAM (Random Access Memory). The CPU controls each portion of the system while reading a program corresponding to the control procedure stored in the ROM. The RAM stores working data and input data, and the CPU performs control by referring to the data stored in the RAM based on the aforementioned program, etc.

[Sheet Charge Adjustment]

Figure 3:
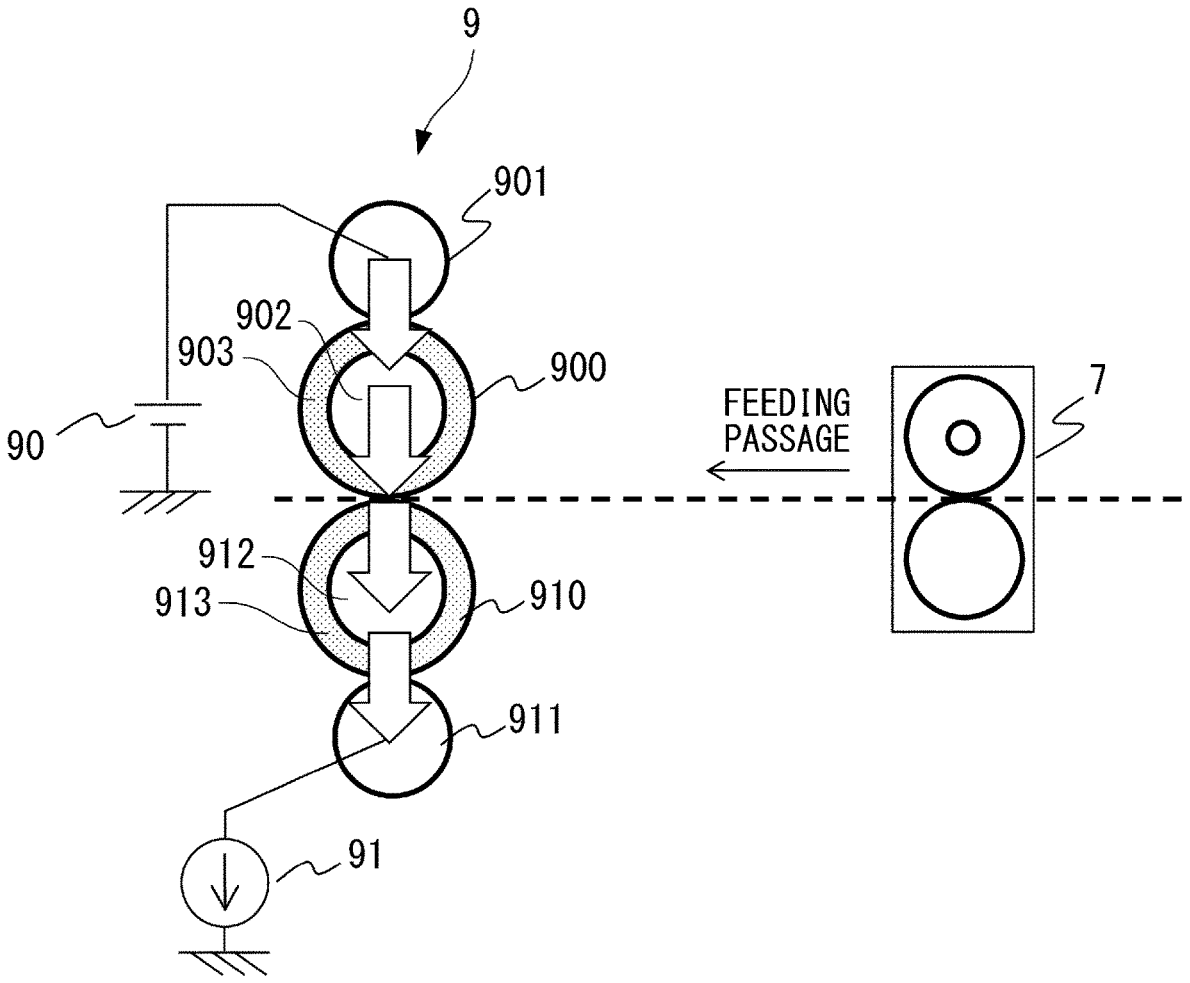
FIG. 3 is a schematic cross-sectional view of a charge adjusting unit according to the first embodiment.

Here, in the present embodiment, in order to prevent sheets stacked in the discharge tray from sticking to each other due to static electricity, a charge adjusting portion, charge adjusting portion 9, is located downstream of the fixing unit 7 and upstream of the discharge roller 85 (FIG. 1) with respect to the feeding direction of the sheets, as shown in FIG. 3. The charge adjusting unit 9 adjusts the electric charge to the sheet on which the toner image has been fixed by the fixing unit 7.

COMPARATIVE EXAMPLE

First, the configuration example described in JP 2016-122156 mentioned above is described as a comparative example. A charge adjusting unit 60 in the comparative example has a first conductive rubber roller 61 and a second conductive rubber roller 62, which are arranged opposite to each other. A metal core 61*a* of the first conductive rubber roller 61 is connected to a power source 63, and the second conductive rubber roller 62 is grounded. The power source 63 applies a positive (positive polarity) voltage to the first conductive rubber roller 61. When a positive voltage is applied to the first conductive rubber roller 61, a positive charge is imparted to the second (back) side P2 of the sheet P. A negative charge of the same amount as the positive charge imparted by the first conductive rubber roller 61 is induced in the second conductive rubber roller 62 and cancels out the positive (negative polarity) charge of the first side (surface) P1 of the sheet P. The power source 63 is constant-current controlled and applies a constant-current controlled voltage to the sheet P at a predetermined current value. This adjusts the charge on the sheets P and prevents the sheets from sticking when stacked.

Figure 4:
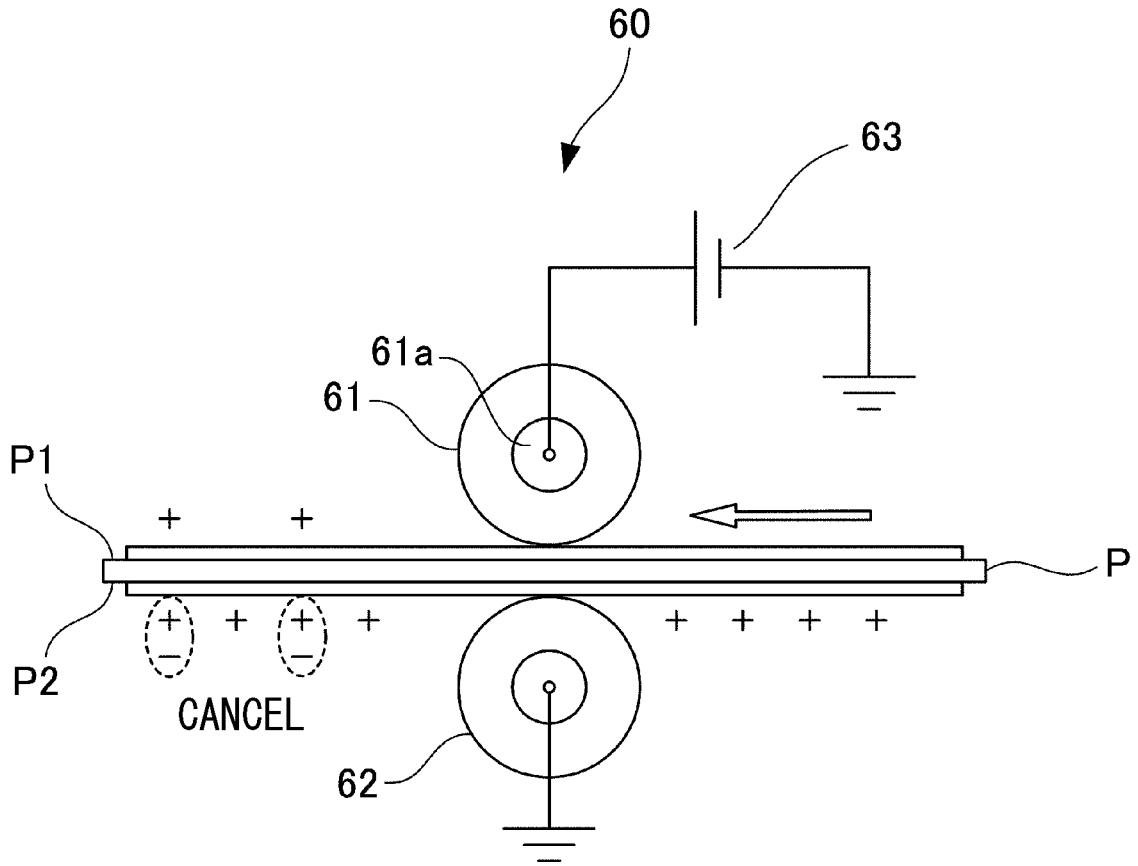
FIG. 4 is a schematic cross-sectional view of a charge adjusting unit according to a comparative example.

However, when charge adjustment is performed by constant current control in the configuration example of the comparative example shown in FIG. 4, a constant charge adjustment current will continue to flow if one type of sheet is continuously passed through under a constant temperature and humidity environment. And if the conductive rubber roller (charge adjustment roller) used has a configuration that contains at least an ion conductive material and an increase in electrical resistance according to the amount of current flow, measures such as increasing the voltage applied according to the time of use are required in order to provide the desired electric charge.

In general, there is an upper limit to the high-voltage capacity of the power source, so if the printer continues to be used under the conditions of the comparative example, a constant charge adjustment current cannot be applied, and the choice is to either lower the charge adjustment current value or replace the charge adjustment roller. If the charge adjustment current value is lowered, naturally the amount of charge on the sheet will change, so the stacking performance will not be stable. If the charge adjustment roller is replaced, downtime and increased initial costs are inevitable. Therefore, the configuration of the charge adjusting unit in this system is as follows.

[Charge Adjusting Unit of the Present Embodiment]

FIG. 3 is a view of a charge adjusting unit 9 in the present embodiment. The dashed line shows the feeding path of a sheet P. The charge adjusting unit 9 is located downstream of the fixing unit 7. The charge adjustment device 9 is composed of an upper charge adjustment roller 900 as the first roller, a lower charge adjustment roller 910 as the second roller, an upper power feeding roller 901 as the power feeding roller and the first power feeding roller, a lower power feeding roller 911 as the second power feeding roller, a high voltage power source 90 as the power source and the first power source, and a high voltage power source 91 as the second power source. The upper power feeding roller 901, upper charge adjustment roller 900, lower charge adjustment roller 910, and lower power feeding roller 911 are arranged in this order from the top. The adjacent rollers are in contact with each other, being urged by a spring member with a load of 1 kgf.

The upper charge adjusting roller 900 has a metal core (rotating shaft) 902 as a conductive shaft portion and a first shaft portion, and an elastic layer 903 as an outer circumference portion and a first outer circumference portion containing an ion conductive material formed on the outer circumference of the metal core 902. The lower charge adjusting roller 910 has a metal core (rotating shaft) 912 as a conductive second shaft portion and an elastic layer 913 as a second outer circumference portion including an ion conductive material formed on the outer circumference of the metal core 912.

These upper charge adjusting roller 900 and lower charge adjusting roller 910 are semi-conductive rollers, and the elastic layers 903 and 913 are made of an ion-conductive material formed from a blend of nitrile rubber and ethylene-epichlorohydrin copolymer. The upper charge adjusting roller 900 and the lower charge adjusting roller 910 are electrically floating, respectively. That is, the upper charge adjusting roller 900 and the lower charge adjusting roller 910 are not directly connected to a power source, nor are they grounded, respectively.

The lower charge adjusting roller 910 is arranged to hold the sheet between the upper charge adjusting roller 900 and itself. Specifically, both ends of the metal core of one of the upper charge adjusting rollers 900 and the metal core 912 of the lower charge adjusting roller 910 are urged toward the other charge adjusting roller by a spring member, so that the elastic layers 903 and 913 are pressed together to form a nip portion. Thus, a sheet passing through the fixing unit 7 passes through the nip portion formed between the upper charge adjusting roller 900 and the lower charge adjusting roller 910.

The upper charge feeding roller 901 is in contact with the upper charge adjusting roller 900 and can supply current to the upper charge adjusting roller 900. The upper charge feeding roller 901 is urged toward the upper charge adjusting roller 900 by a spring member. The high voltage power source 90 is capable of applying a voltage of one of the positive and negative polarity to the upper charge feeding roller 901. In the present embodiment, the high voltage power source 90 applies a positive (positive polarity) voltage to the upper charge feed roller 901. In the present embodiment, the high voltage power source 90 is a constant voltage power source. However, the high voltage power source 90 may also be a constant current power source.

The lower charge feeding roller 911 is in contact with the lower charge adjusting roller 910 and can supply electric current to the lower charge adjusting roller 910. The lower charge feeding roller 911 is urged toward the lower charge adjusting roller 910 by a spring member. The high voltage power source 91 is capable of applying a voltage of the other polarity between positive and negative polarity to the lower charge feeding roller 911. In the present embodiment, the high voltage power source 91 applies a negative (negative polarity) voltage to the lower charge feeding roller 911. In the present embodiment, the high voltage power source 91 is a constant current power source. However, the high voltage power source 91 may also be a constant voltage power source.

The high voltage power source 90 and high voltage power source 91 are controlled by the control portion 110. The control portion 110 determines the amount of charge to be applied to the sheet according to the coverage (the ratio of the area of the toner image to the area of the sheet) of both sides of the sheet. For example, the control portion 110 calculates the coverage based on the information of the image to be formed on that sheet, and determines whether or not to apply voltage to the sheet from the high voltage power source 90 and the high voltage power source 91, and if so, the current value to be supplied from the high voltage power source 90 and the high voltage power source 91. This enables appropriate charge adjustment according to the sheet coverage.

In such an embodiment, by applying voltage from the high voltage power source 90 and the high voltage power source 91 to the upper charge feeding roller 901 and the lower charge feeding roller 911, respectively, a current flows between the upper charge adjusting roller 900 and the lower charge adjusting roller 910 in the direction of the arrow. At this time, the elastic layers 903 and 913 containing ion conductive material of the upper charge adjusting roller 900 and lower charge adjusting roller 910 are polarized in the nip portion. That is, the ions in the ion-conductive material are polarized so that they are biased toward the roller surface. Here, as in the comparative example, when voltage is applied to the metal core 61*a* of the first conductive rubber roller 61, it is polarized at the nip portion side with the second conductive rubber roller 62, and the electrical resistance of the conductive rubber rollers is easily increased.

Therefore, in order to suppress the increase in electrical resistance caused by such polarization, in the present embodiment, the upper charge adjusting roller 900 and the lower charge adjusting roller 910 are supplied with voltage from the upper charge feeding roller 901 and the lower charge feeding roller 911, which are in contact with the respective surfaces of the upper charge adjusting roller 900 and the lower charge adjusting roller 910, respectively, to which voltage is applied. As a result, the polarization of ions generated at the nip portion between the upper charge adjusting roller 900 and the lower charge adjusting roller 910 in the elastic layers 903 and 913 is relaxed at the nip portion between the upper charge adjusting roller 900 and the lower charge adjusting roller 910 and the upper charge feeding roller 901 and the lower charge feeding roller 911. The polarization of ions on the upper charge adjusting roller 900 and lower charge adjusting roller 910 is then suppressed, and the resistance of the upper charge adjusting roller 900 and lower charge adjusting roller 910 increases with use. As a result, the charge adjusting unit 9 can perform stable charge adjustment of the sheet over a long period of time.

Example 1

Next, an experiment conducted to confirm the effects of the present embodiment described above is described. In the experiment, a charge adjusting unit 9A shown in part (a) of FIG. 5 was used. The charge adjusting unit 9A of Example 1 has a charge adjusting roller 900Aa as the first roller, an opposing roller 910Aa as the second roller, a charge feeding roller 901Aa as the charge feeding roller, and a high voltage power source 90A as the power source. The charge adjusting roller 900Aa has a metal core (rotating shaft) 902Aa as a conductive portion of the shaft, and an elastic layer 903Aa as an outer portion containing ion-conductive material formed on the outer circumference of the metal core 902Aa. The charge adjusting roller 900Aa is a semi-conductive roller, and the elastic layer 903Aa is formed of an ion-conductive material formed by blending nitrile rubber and ethylene-epichlorohydrin copolymer. The charge adjusting roller 900Aa is electrically floating.

The opposing roller 910Aa is arranged to hold the sheet between it and the charge adjusting roller 900Aa. Specifically, both ends of the metal core 902A of the charge adjusting roller 900Aa are urged toward the opposing roller 910Aa by a spring member, so that the elastic layer 903Aa presses against the opposing roller 910Aa to form a nip portion. The opposing roller 910Aa is grounded.

The charge feeding roller 901Aa can contact the charge adjusting roller 900Aa and supply current to the charge adjusting roller 900Aa. The high voltage power source 90A is capable of applying a voltage of one of positive and negative polarity to the charge feeding roller 901Aa. In Example 1, the high voltage power source 90A applies a positive (positive polarity) voltage to the charge feeding roller 901Aa. The high voltage power source 90A is a constant current power source, but it can also be a constant voltage power source.

In the experiment, voltage fluctuations were measured in the charge adjusting unit 9A, which has this configuration, when a constant current continues to flow from the high voltage power source 90A. The experimental conditions were as follows. The opposing roller 910Aa and the charge feeding roller 901Aa are metal rollers of 30 mm in diameter, respectively.

The charge adjusting roller 900Aa is a semi-conductive roller with a diameter of 20 mm. The high voltage power source 90A is a constant current power source. Each roller is rotating at 240 mm/sec in the direction of the arrow, and a current of 20 μA is continuously flowing from the high voltage power source 90A.

Part (b) of FIG. 5 shows the results of the measurement of the experimental example 1. In part (b) of FIG. 5, the horizontal axis is time and the vertical axis is applied voltage. The results show that although short-term voltage fluctuations remain when spanning over days, long-term voltage fluctuations are hardly observed, indicating that the applied voltage is stable. The charge adjusting unit 9A shown in part (a) of FIG. 5 is an experimental configuration, so the current flows from the bottom to the top of the Figure, but it can also be reversed.

Modified Example 1

FIG. 6 shows a modified example 1 of the present embodiment. A charge adjusting unit 9B of the modified example 1 has a charge adjusting roller 900A as a first roller, an opposing roller 910A as a second roller, a charge feeding roller 901A as a charge feeding roller, a high voltage power source 90A as a power source and a first power source, as in Example 1 shown in part (a) of FIG. 5. The charge adjusting roller 900A has a metal core (rotating shaft) 902A as a conductive portion and an elastic layer 903A as an outer circumference portion including an ion conductive material formed on the outer circumference of the core 902A. The charge adjusting roller 900A is a semi-conductive roller, and the elastic layer 903A is formed by an ion-conductive material formed by blending nitrile rubber and ethylene-epichlorohydrin copolymer. In modified example 1, the charge adjusting roller 900A is also floating. However, unlike Example 1, in modified example 1, the opposing roller 910A is not grounded, but is connected to the high voltage power source 91A as a second power source.

The opposing roller 910A and charge feeding roller 901A are each metal rollers with an outer diameter of φ16 mm, for example. The charge adjusting roller 900A is a semi-conductive roller. The elastic layer 903A is formed of an ion conductive material made of a blend of nitrile rubber and ethylene-epichlorohydrin copolymer, and has an outer diameter of φ20 mm, for example. The outer diameter of the metal core 902A1 is, for example, φ16 mm.

The high voltage power source 90A connected to the charge feeding roller 901A is capable of applying a voltage of either positive or negative polarity to the charge feeding roller 901A. In the present embodiment, the high voltage power source 90A applies a negative (negative polarity) voltage to the charge feeding roller 901A. On the other hand, the high voltage power source 91A, which is connected to the opposing roller 910A, is capable of applying a voltage of the other polarity of positive and negative polarity to the opposing roller 910A. In the present embodiment, the high voltage power source 91A applies a positive (positive polarity) voltage to the charge feeding roller 901A. In the present embodiment, the high voltage power source 90A is a constant current power source and the high voltage power source 91A is a constant voltage power source, but the high voltage power source can be either a constant voltage power source or a constant current power source.

In the case of modified example 1, by applying voltage from the high voltage power sources 91A and 90A to the opposing roller 910A and the charge feeding roller 901A, respectively, current flows from the opposing roller 910A to the charge feeding roller 901A via the charge adjusting roller 900A in the direction of the arrow. As in the case described in the first embodiment, this suppresses the polarization of the ions in the charge adjusting roller 900A and prevents the resistance of the charge adjusting roller 900A from increasing with use. As a result, the charge adjusting unit 9B can stably adjust the charge of the sheet over a long period of time.

Modified Example 2

Modified example 2 of the present embodiment is shown in FIG. 7. The charge adjusting unit 9C in the modified example 2 has an upper charge adjusting roller 900 as the first roller and a lower charge adjusting roller 910 as the second roller, as in the first embodiment shown in FIG. 3. It also has an upper charge feeding roller 901 as the charge feeding roller and first charge feeding roller, a lower charge feeding roller 911 as the second charge feeding roller, a high voltage power source 90 as the power source and first power source, and a high voltage power source 91 as the second power source.

Here, the upper charge adjusting roller 900 is electrically floating, while the lower charge adjusting roller 910 is grounded. In the present embodiment, the lower charge adjusting roller 910 is grounded, but current flows from the high voltage power source 90 to the lower charge adjusting roller 910 via the upper charge feeding roller 901 and the upper charge adjusting roller 900, and current also flows from the high voltage power source 91 to the lower charge adjusting roller 910 via the lower charge feeding roller 911. Thus, current flows from the upper charge feeding roller 901 to the lower charge feeding roller 911 in the direction of the arrow in the Figure. As in the case described in the first embodiment, this suppresses the polarization of ions in the upper charge adjusting roller 900 and lower charge adjusting roller 910, and the resistance of the upper charge adjusting roller 900 and lower charge adjusting roller 910 increases with use. As a result, the charge adjusting unit 9B can perform stable charge adjustment of the sheet over a long period of time. The upper charge adjusting roller 900 may also be grounded. That is, either one of the upper charge adjusting roller 900 and the lower charge adjusting roller 910 can be floating and the other grounded, or both can be grounded.

Second Embodiment

The second embodiment is described using FIGS. 8 through 12. In the first embodiment described above, the configuration in which the charge adjusting roller is floating is explained, but in the present embodiment, the charge adjusting roller is grounded. Since other configurations and actions are similar to the first embodiment described above, the same symbols are attached to similar configurations to omit or simplify the explanation, and the following explanation will focus on the points that differ from the first embodiment.

First, a typical configuration of the present embodiment is described using FIG. 8. Similar to modified example 1 shown in FIG. 6, a charge adjusting unit 9D of the present embodiment shown in FIG. 8 has a charge adjusting roller 900A as the first roller, an opposing roller 910A as the second roller, a charge feeding roller 901A as the charge feeding roller, a high voltage power source 90A as the power source and the first power source, and a high voltage power source 91A as the second power source. However, in the present embodiment, unlike modified example 1, the charge adjusting roller 900A is grounded. In the present embodiment, the high voltage power source 90A that applies voltage to the charge feeding roller 901A is a constant current power source, and the high voltage power source 91A that applies voltage to the opposing roller 910A is a constant voltage power source. The feeding high voltage can be either a constant voltage power source or a constant current power source.

The opposing roller 910A and charge feeding roller 901A are each metal rollers with an outer diameter of φ16 mm, for example. The charge adjusting roller 900A is a semi-conductive roller. The elastic layer 903A is formed of an ion conductive material made of a blend of nitrile rubber and ethylene-epichlorohydrin copolymer, and has an outer diameter of φ20 mm, for example. The outer diameter of the metal core 902A1 is, for example, φ16 mm.

In such an embodiment, the charge adjusting roller 900A is grounded, but current flows from the high voltage power source 90A to the charge adjusting roller 900A via the charge feeding roller 901A, and current also flows from the high voltage power source 91A to the charge adjusting roller 900A via the opposing roller 910A. Thus, current flows in the direction of the arrow in the Figure from the charge feeding roller 901A to the opposing roller 910A.

As in the case described in the first embodiment, this suppresses the polarization of the ions in the charge adjusting roller 900A and prevents the resistance of the charge adjusting roller 900A from increasing with use. As a result, the charge adjusting unit 9D can stably adjust the charge of the sheet over a long period of time.

Example 2

Next, an experiment conducted to confirm the effects of the present embodiment described above is explained. In the experiment, a charge adjusting unit 9E shown in part (a) of FIG. 9 was used. The charge adjusting unit 9E in Example 2 has a charge adjusting roller 900Aa as the first roller, an opposing roller 910Aa as the second roller, and a charge feeding roller 901Aa as the charge feeding roller, similar to Example 1 shown in part (a) of FIG. 5. However, in Example 2, the charge adjusting roller 900Aa is grounded. In addition, voltage is applied to the opposing roller 910Aa. In Example 2, a high voltage power source 90A, which applies voltage to the charge feeding roller 901Aa, is a constant current power source, and a high voltage power source 91B, which applies voltage to the opposing roller 910Aa, is also a constant current power source.

In the experiment, voltage fluctuations were measured in the charge adjusting unit 9E, which has this configuration, when a constant current is continuously applied from the high voltage power source 90B and 91A. The experimental conditions were as follows. The opposing roller 910Aa and the charge feeding roller 901Aa are metal rollers with a diameter of 30 mm, respectively. The charge adjusting roller 900Aa is a semi-conductive roller with a diameter of 20 mm. Each roller is rotating at 240 mm/sec in the direction of the arrow, and a 20 μA current is continuously flowing from the high voltage power source 90B and 91A.

Part (b) of FIG. 9 shows the measurement results of the experimental example 2. In part (b) of FIG. 9, the horizontal axis is time and the vertical axis is the applied voltage. The solid line in part (b) of FIG. 9 shows summer with the application of the high voltage power source 90B, and the dashed line shows summer with the application of the high voltage power source 91A. From these results, it can be seen that although short-term voltage fluctuations remain when spanning days, long-term voltage fluctuations are hardly observed, indicating that the applied voltage is stable. The charge adjusting unit 9E shown in part (a) of FIG. 9 is an experimental configuration, so the current flows from the bottom to the top of the figure, but it can be reversed.

Modified Example 3

FIG. 10 shows a modified example 3 of the present embodiment. A charge adjusting unit 9F in the modified example 3 is similar to the second embodiment shown in FIG. 8, with a charge adjusting roller 900A as the first roller, an opposing roller 910A as the second roller, a charge feeding roller 901A as the charge feeding roller, a high voltage power source 90B as the power source and the first power source, and a high voltage power source 91 B as the second power source. However, in the modified example 3, the high voltage power source 90B, which applies voltage to the feeding roller 901A, is a constant voltage power source, and the high voltage power source 91B, which applies voltage to the opposing roller 910A, is a constant current power source.

Modified Example 4

FIG. 11 shows a modified example 4 of the present embodiment. As in the second embodiment shown in FIG. 8, a charge adjusting unit 9G in the modified example 4 has a charge adjusting roller 900A as the first roller, an opposing roller 910A as the second roller, a charge feeding roller 901A as the charge feeding roller, a high voltage power source 90B as the power source and the first power source, and a high voltage power source 91A as the second power source. However, in the modified example 4, the high voltage power source 90B, which applies voltage to the charge feeding roller 901A, is a constant voltage power source, and the high voltage power source 91A, which applies voltage to the opposing roller 910A, is also a constant voltage power source.

Modified Example 5

FIG. 12 shows a modified example 5 of the present embodiment. As in the second embodiment shown in FIG. 8, a charge adjusting unit 9H in the modified example 5 has a charge adjusting roller 900A as the first roller, an opposing roller 910A as the second roller, a charge feeding roller 901A as the charge feeding roller, a high voltage power source 90A as the power source and the first power source, and a high voltage power source 91B as the second power source. However, in the modified example 5, the high voltage power source 90A, which applies voltage to the charge feeding roller 901A, is a constant current power source, and the high voltage power source 91B, which applies voltage to the opposing roller 910A, is also a constant current power source.

Embodiment 3

As a third embodiment, the relationship between the preferred external charge feeding current and the static elimination current in each of the above configurations is explained. Here, the static elimination current is the current flowing into the sheet in the nip portion, and the external charge feeding current is the current flowing out of the sheet in the nip portion. Specifically, in FIGS. 3 and 7, when the first and second charge feeding rotating elements are the first rotating element to which positive polarity voltage is applied and the second rotating element to which negative polarity voltage is applied, the current flowing into the first rotating element is the static eliminating current and the current flowing into the second rotating element is the external charge feeding current. That is, in FIGS. 3 and 7, the current flowing to the upper charge feeding roller 901 is the static eliminating current and the current flowing to the lower charge feeding roller 911 is the external charge feeding current. In part (a) of FIG. 5, the current flowing to the charge feeding roller 901Aa as the charge feeding rotating member is the static elimination current, and the current flowing to the opposing roller 910Aa as the second roller is the external charge feeding current.

Furthermore, in FIGS. 6 and 8 through 12, when the charge feeding rotating member or roller to which a positive polarity voltage is applied is the first rotating member and the charge feeding rotating member or roller to which a negative polarity voltage is applied is the second rotating member, the current flowing in the first rotating member is the static elimination current and the current flowing in the second rotating member is the external charge feeding current. That is, in FIGS. 6, 8, 10, 11, and 12, the current flowing to the opposing roller 910A is the static eliminating current and the current flowing to the charge feeding roller 901A is the external charge feeding current. In part (a) of FIG. 9, the current flowing to the charge feeding roller 901Aa is the static elimination current and the current flowing to the opposing roller 910Aa is the external charge feeding current.

Example 3

In the following, the charge adjusting unit 9E in Example 2 shown in part (a) of FIG. 9 is used as a representative example, but the same applies to other charge adjusting units. FIG. 13 shows the relationship between the static elimination current and the external charge feeding current.

Considering the symbol of the current with respect to the sheet in the nip portion, it is common to consider the current flowing into the sheet (static elimination current) to be positive and the current flowing out of the sheet (external charge feeding current) to be negative. However, in the present example, in order to facilitate comparative examples of the static elimination current and the external charge feeding current, the static elimination current and the external charge feeding current are explained in absolute values. In FIG. 13, the static elimination current is shown as a thin line and the external charge feeding current as a thick line.

With respect to the static elimination current and external charge feeding current, following the passage of time, the processes are classified into three major categories: pre-rotation, ongoing charge adjustment, and post-rotation. The pre-rotation is the period during which the charge adjusting roller 900Aa, opposing roller 910Aa, and charge feeding roller 901Aa are rotating before the leading end of the first sheet enters the nip portion in an image forming job in which images are continuously formed on multiple sheets. The ongoing charge adjustment is the period during which multiple sheets are passing through the nip portion. In addition to the actual passage of a sheet through the nip portion, it also includes the period from the time the trailing end of a sheet passes through the nip portion until the leading end of a subsequent sheet that is consecutive to said sheet enters the nip portion (sheet interval), the so-called "paper interval." The charge adjusting roller 900Aa, opposing roller 910Aa, and charge feeding roller 901Aa are still rotating during ongoing charge adjustment. Post-rotation is the period during which the charge adjusting roller 900Aa, opposing roller 910Aa, and charge feeding roller 901Aa are rotating after the trailing end of the last sheet has passed through the nip portion in the image forming job.

In the present example, the value of the current value of the static elimination current during pre-rotation and post-rotation and the value of the external charge feeding current were set at the same setting of 30 μA. During ongoing charge adjustment, the current value of the static eliminating current during the passage of the sheet through the nip portion was set at a constant value of 40 μA, and the current value of the static eliminating current during the paper interval was set at a constant value of 30 μA. The current value of the external charge feeding current during ongoing charge adjustment was set at 35 μA, which is between 40 μA, the current value during the passing of the static elimination current, and 30 μA which is the current value during the paper interval.

The current value was set to the above conditions, and in a temperature and humidity environment of 23° C., 5% RH, the charge adjusting roller 900Aa was first left in this environment for one week, with no metal roller (i.e., opposing roller 910Aa) in contact with the top of the device in part (a) of FIG. 9, and the initial resistance was measured when the voltage was set to 2 kV, the rotation speed was 15 rpm, and the applied voltage from the high voltage power source 90A was 4.0 E+7Ω.

Next, an endurance test was conducted using an image forming apparatus with a peripheral speed of 200 mm/sec in the same temperature and humidity environment to perform continuous image forming. In the test, A4 size Canon Inc. paper GF-C081 (basis weight 81.4 g/m$^2$) was used. In this test, the resistance of the charge adjusting roller 900Aa was measured under the same conditions as above after this paper was passed through the charge adjusting portion of the charge adjusting unit 9E for an accumulated number of 600,000 sheets. As a result, the resistance value was 5.0 E+7Ω, which was 1.25 times higher than the initial resistance value, a slight increase. However, the resistance did not increase to the extent that the order of magnitude of the resistance value changed, as in the past, and the effect was confirmed to be sufficient.

Thus, it was found that the amount of charge present on the surface of the sheets is adjusted in each of the above-mentioned embodiments, which prevents the sheets from sticking to each other due to static electricity and enables stable charge adjustment over a long period of time.

In addition, as described above, the absolute value of the external charge feeding current during charge adjustment, which is the period including the time during the passage and paper interval, should be between the absolute value of the ionizing current during the passage and the absolute value of the ionizing current between papers, so that the ions polarized by the ionizing current can be suitably mitigated by the external charge feeding current.

Furthermore, as described above, the external charge feeding current when a sheet is continuously passed through the nip portion of the charge adjusting unit is a constant value between the current value during the passage of the charge eliminating current and the current value between sheets. This was found to be highly effective with respect to mitigating the polarization of the conductive agent generated in the static elimination process by the external charge feeding current, with a simple control without complications.

OTHER EMBODIMENTS

The present invention is not limited to the above embodiments, but can be applied to other power-feeding members and other types of image forming apparatus. In addition, in each of the above embodiments, the numerical values, etc. used in the explanation are merely examples, and the present invention is not limited thereto.

In any of the above embodiments, charge adjustment of sheets can be performed stably over a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2021-192320 filed on Nov. 26, 2021 and 2022-114743 filed on Jul. 19, 2022, which are hereby incorporated by reference herein in their entirety.

What is claimed is:

1. An image forming apparatus comprising:

a transfer portion configured to transfer a toner image on a sheet;

a fixing portion configured to heat and press the sheet on which the toner image is transferred by the transfer portion, and to fix the toner image onto the sheet; and a charge adjusting portion configured to adjust charge to the sheet on which the toner image is fixed by the fixing portion, wherein the charge adjusting portion is provided with a first roller including a shaft portion having conductivity and an outer circumferential portion including an ion conductive material formed on an outer periphery of the shaft portion, and being electrically floating, a second roller disposed so as to nip the sheet between itself and the first roller;

a supplying rotatable member in contact with the first roller and configured to supply a current to the first roller; and a power source configured to apply a voltage of one polarity of a positive polarity and a negative polarity to the supplying rotatable member.

2. An image forming apparatus according to claim 1, wherein the shaft portion is a first shaft portion, the outer circumferential portion is a first outer circumferential portion, the second roller including a second shaft portion having conductivity and a second outer circumferential portion including an ion conductive material formed on an outer periphery of the second shaft portion, the supplying rotatable member is a first supplying rotatable member, and the power source is a first power source, and wherein the charge adjusting portion is further provided with a second supplying rotatable member in contact with the second roller and configured to supply a current to the second roller; and a second power source configured to apply a voltage of the other polarity of the positive polarity and the negative polarity to the second supplying rotatable member.

3. An image forming apparatus according to claim 2, wherein in a case that a plurality of sheets are continuously passed through a nip portion nipping the sheet between the first roller and the second roller, when a period when the sheet is passing through the nip portion is a passing period, a period from a trailing end of the sheet passes through the nip portion until an leading end of a subsequent sheet continuously following the sheet enters into the nip portion is a sheet interval, and one of the first supplying rotatable member and the second supplying rotatable member to which the voltage of the positive polarity is applied is a first rotatable member and one to which the voltage of the negative polarity is applied is a second rotatable member, an absolute value of the current flowing through the second rotatable member in a period including the passing period and the interval period is between an absolute value of the current flowing through the first rotatable member in the passing period and an absolute value of the current flowing through the first rotatable member in the interval period.

4. An image forming apparatus according to claim 2, wherein the second roller is electrically floating.

5. An image forming apparatus according to claim 2, wherein the second roller is grounded.

6. An image forming apparatus according to claim 1, wherein the power source applied the voltage of the positive polarity to the supplying rotatable member, and the second roller is grounded, and wherein in a case that a plurality of sheets are continuously passed through a nip portion nipping the sheet between the first roller and the second roller, when a period when the sheet is passing through the nip portion is a passing period, a period from a trailing end of the sheet passes through the nip portion until an leading end of a subsequent sheet continuously following the sheet enters into the nip portion is a sheet interval, an absolute value of the current flowing through the second roller in a period including the passing period and the interval period is between an absolute value of the current flowing through the supplying rotatable member in the passing period and an absolute value of the current flowing through the supplying rotatable member in the interval period.

7. An image forming apparatus according to claim 1, wherein the power source is a first power source, and the second roller is a metal roller, and wherein the charge adjusting portion is further provided with a second power source configured to apply a voltage of the other polarity of the positive polarity and the negative polarity to the second roller.

8. An image forming apparatus according to claim 7, wherein in a case that a plurality of sheets are continuously passed through a nip portion nipping the sheet between the first roller and the second roller, when a period when the sheet is passing through the nip portion is a passing period, a period from a trailing end of the sheet passes through the nip portion until an leading end of a subsequent sheet continuously following the sheet enters into the nip portion is a sheet interval, and one of the supplying rotatable member and the second roller to which the voltage of the positive polarity is applied is a first rotatable member and one to which the voltage of the negative polarity is applied is a second rotatable member, an absolute value of the current flowing through the second rotatable member in a period including the passing period and the interval period is between an absolute value of the current flowing through the first rotatable member in the passing period and an absolute value of the current flowing through the first rotatable member in the interval period.

9. An image forming apparatus according to claim 1, wherein the power source is a constant voltage power source.

10. An image forming apparatus according to claim 1, wherein the power source is a constant current power source.

11. An image forming apparatus comprising:

a transfer portion configured to transfer a toner image on a sheet;

a fixing portion configured to heat and press the sheet on which the toner image is transferred by the transfer portion, and to fix the toner image onto the sheet; and a charge adjusting portion configured to adjust charge to the sheet on which the toner image is fixed by the fixing portion, wherein the charge adjusting portion is provided with a first roller including a shaft portion having conductivity and an outer circumferential portion including an ion conductive material formed on an outer periphery of the shaft portion, and grounded, a metallic second roller disposed so as to nip the sheet between itself and the first roller;

a supplying rotatable member in contact with the first roller and configured to supply a current to the first roller;

a first power source configured to apply a voltage of one polarity of a positive polarity and a negative polarity to the supplying rotatable member, and a second power source configured to apply a voltage of the other polarity of the positive polarity and the negative polarity to the second roller.

12. An image forming apparatus according to claim 11, wherein in a case that a plurality of sheets are continuously passed through a nip portion nipping the sheet between the first roller and the second roller, when a period when the sheet is passing through the nip portion is a passing period, a period from a trailing end of the sheet passes through the nip portion until an leading end of a subsequent sheet continuously following the sheet enters into the nip portion is a sheet interval, and one of the supplying rotatable member and the second roller to which the voltage of the positive polarity is applied is a first rotatable member and one to which the voltage of the negative polarity is applied is a second rotatable member, an absolute value of the current flowing through the second rotatable member in a period including the passing period and the interval period is between an absolute value of the current flowing through the first rotatable member in the passing period and an absolute value of the current flowing through the first rotatable member in the interval period.

13. An image forming apparatus according to claim 11, wherein at least one of the first power source and the second power source is a constant voltage power source.

14. An image forming apparatus according to claim 11, wherein at least one of the first power source and the second power source is a constant current power source.

15. An image forming apparatus comprising:

a transfer portion configured to transfer a toner image on a sheet;

a fixing portion configured to heat and press the sheet on which the toner image is transferred by the transfer portion, and to fix the toner image onto the sheet; and a charge adjusting portion configured to adjust charge to the sheet on which the toner image is fixed by the fixing portion, wherein the charge adjusting portion is provided with a first roller including a shaft portion having conductivity and an outer circumferential portion including an ion conductive material formed on an outer periphery of the shaft portion, a second roller configured to nip the sheet between itself and the outer circumferential portion of the first roller;

a supplying rotatable member in contact with the outer circumferential portion of the first roller and configured to supply a current to the first roller;

a power source configured to apply a voltage of one polarity of a positive polarity and a negative polarity to the supplying rotatable member.

16. An image forming apparatus according to claim 15, wherein the shaft portion is a first shaft portion, the outer circumferential portion is a first outer circumferential portion, the second roller including a second shaft portion having conductivity and a second outer circumferential portion including an ion conductive material formed on an outer periphery of the second shaft portion, the supplying rotatable member is a first supplying rotatable member, and the power source is a first power source, and wherein the charge adjusting portion is further provided with a second supplying rotatable member in contact with the second roller and configured to supply a current to the second roller; and a second power source configured to apply a voltage of the other polarity of the positive polarity and the negative polarity to the second supplying rotatable member.

17. An image forming apparatus according to claim 15, wherein the second roller is grounded.

18. An image forming apparatus according to claim 15, wherein the shaft portion of the first roller is grounded.

19. An image forming apparatus according to claim 15, wherein the first roller is electrically floating.

20. An image forming apparatus according to claim 15, wherein the charge adjusting portion is further provided with a second power source configured to apply a voltage of the other polarity of the positive polarity and the negative polarity to the second roller.

* * * * *